US005599016A

United States Patent [19]

Larkin

[11] Patent Number: 5,599,016

[45] Date of Patent: Feb. 4, 1997

[54] MUSCLE-MEMORY METHOD AND BASKETBALL TRAINING AID

[76] Inventor: Martin Larkin, 730 Rosemont Ave., Pacific Grove, Calif. 93950

[21] Appl. No.: 492,439

[22] Filed: Jun. 19, 1995

Related U.S. Application Data

[63] Continuation-in-part of Ser. No. 320,437, Oct. 7, 1994, abandoned.

[51] Int. Cl.[6] ..... A63B 69/00

[52] U.S. Cl. ..... 473/448

[58] Field of Search ..... 273/1.5 A, 1.5 R; 248/97, 98

[56] References Cited

U.S. PATENT DOCUMENTS

| | | | |
|---|---|---|---|
| 1,145,297 | 7/1915 | Erickson et al. | 248/97 |
| 3,768,763 | 10/1973 | Hembree | 248/97 |
| 4,538,808 | 9/1985 | Holland | 273/1.5 A |
| 4,565,527 | 1/1986 | Burchett | 434/248 |
| 4,576,350 | 3/1986 | Bond | 248/97 |
| 5,048,712 | 9/1991 | Wolters | 248/98 X |
| 5,074,552 | 12/1991 | Gomez | 273/1.5 A |
| 5,183,226 | 2/1993 | Brooks | 248/97 |

OTHER PUBLICATIONS

Select Service & Supply Co., Inc, Sporttime Catalog, 1993 Summer Edition, p. 28, Duogoal Basketball System.

*Primary Examiner*—Paul E. Shapiro

*Attorney, Agent, or Firm*—Robert Charles Hill

[57] ABSTRACT

A muscle memory basketball training aid and method is provided. The training aid includes a pair of base assemblies and a rectangular frame detachably coupled to the base assemblies. The frame includes a pair of shooting bars and a pair of end bars detachably coupled to the shoot bars. A pair of extension members are detachbly coupled to the base assemblies and to the frame. A locking device is provided that enables longitudinal adjustment of the extension members relative to the base assemblies, for adjusting the height of the frame assembly relative to the base assemblies. The locking device enables each extension member to be adjusted independently of the other, so that the frame assembly may extend obtusely above the base assemblies, to accommodate plural users of different heights. The training aid is implemented by adjusting the frame assembly to a predetermined height, determined by adjusting the extension members, until the shooting bar extends parallel to a user's wrist, when the user's shooting arm is extended into a finished shooting position. The user is positioned under the opening in the frame and provided with a basketball. The user projects the basketball through the opening in the frame, such that the arm changes from an initial position to the finished shooting position, projecting the basketball towards a target. The motion is repeated to establish muscle-memory of the muscles in the user's shooting arm and the associated muscles, to train the muscles associated with shooting the basketball.

12 Claims, 5 Drawing Sheets

MUSCLE-MEMORY METHOD AND BASKETBALL TRAINING AID

This is a continuation-in-part of application Ser. No. 08/320,437, filed Oct. 7, 1994, abandoned.

FIELD OF THE INVENTION

The present invention relates generally to athletic training aids, and more particularly, to an improved method and apparatus for developing hand and arm muscle-memory to gain consistency in shooting basketballs accurately.

BACKGROUND OF THE INVENTION

Several devices are known that help the player train in proper basketball shooting technique. There are also devices that work to improve shooting accuracy. However, most of the loom devices attach to the body and often restrict hand or arm movement in some way.

For example, U.S. Pat. No. 3,820,783, to Caveness, discloses a transversely extended gauge bar connected to a belt or harness that indicates the height to which a shooter's elbow should be raised before extending the forearm to shoot a basketball.

U.S. Pat. No. 4,377,284, to Oberlin, discloses a device that includes a pair of sleeves. The sleeves fit snugly over the forearms near the elbows of the shooter. The sleeves are interconnected with a stretchable, flexible band, tending to hold the shooter's elbows in proximity when making practice shots.

U.S. Pat. No. 4,383,685, to Bishop, comprises a basketball shooter's training aid. disclosed aid includes a vest and a, elastic elbow sleeve worn on a shooter's shooting arm. The sleeve is slidably attached to a curved bar. A bracing assembly is connected between the guide bar and the vest to maintain proper alignment of the bar.

U.S. Pat. No. 4,579,341, to Furr, discloses a basketball player's shooting guide. The disclosed guide includes a body harness, with a forward projecting L-shaped arm guide rod attached to the back of the harness. The guide rod extends across the outside of the player's shooting arm and tends to control the upper arm, so that the elbow will move in a vertical plane and remain under the ball during the course of a shot.

U.S. Pat. No. 4,805,905, to Haub, discloses a device that includes an attachment that couples to the user's wrist. The attachment includes a protruding feeler device to make physical contact with the fingers upon release of the ball.

A disadvantage common to the above discussed prior an is that they remind the arm, by feel or restriction, of the proper way to make a shot with the basketball. This method develops a physical dependence on an attachment to the body, in order to learn to perform properly. This teaches assisted arm and hand movement when making a shot, instead of independent, automatic arm and hand movement. The disclosed prior art does not address the desirability of practice with complete freedom of movement of the arm and hand.

Further, the disclosed prior art does not address a major problem of follow-through of the wrist, hand, and fingers of the shooting hand, independent of any attachment, such as in a game playing situation. A smooth, continuous, consistent, and completely natural follow-through movement, as opposed to a sudden, restrictive stopping of the hand, is important in developing shooting accuracy and shooting range. U.S. Pat. No. 4,565,527, to Burchette, discloses a method and apparatus for training a human by feedback enhanced learning. The disclosed apparatus includes a sensing frame with a rectangular opening. First and second beams of light extend across the frame to indicate a desired path for a basketball to enter a goal. If either of the beams of light is broken by the basketball, an alarm sounds to indicate to a shooter that the path of the basketball was either too high or too low to enter the goal. A disadvantage of the disclosed device is that it does not address the need for developing the proper arm, wrist, and hand motions when shooting a basketball. A further disadvantage of the device is that a plurality of users can not simultaneously use the device.

U.S. Pat. No. 4,538,808, to Holland, is directed to a device for training basketball players to shoot basketballs. The device consists of a tubular framework to enclose a player. A disadvantage to the disclosed device is that it also does not address the need for developing the proper arm, wrist, and hand motions associated with shooting a basketball.

U.S. Pat. No. 5,047,552 to Gomez et al., issued on Dec. 24, 1991, discloses a basketball-type amusement device. The device includes a backboard rotatably mounted about an axis to present a thrower with a variety of angles from which throws can be made. The device further includes confining walls to form an open-front structure defining a throwing position. A disadvantage of the disclosed device is that it does not aid with developing the proper hand and arm muscle memory associated with shooting a basketball.

A basketball system, sold under the tradename Duo-Goal™, and distributed through Sportime mail order catalogue, Atlanta, Ga., is designed for young children. The disclosed system allows a group of children to shoot balls at up to four basketball goals, that may be set at a variety of heights and positions. The system includes a base that may be filled with either sand or water. An adjustable post is affixed to the base. A pair of basketball goals are individually mounted to the post. The goals can be mounted to the post at the same height, or at different heights.

British Patent No. 520,656, to Dickinson, discloses a netball post. The post includes a telescoping post detachably secured to a base. A net is secured to a ring attached to the post. The base includes a plurality of diametrically opposed members. The length of each of the members is adjustable, for changing the diameter of the base.

Although the devices disclosed in the above enumerated prior art references have improved features, they fail to disclose all of the advantageous features achieved by the present invention.

There, therefore exists a need for device that provides shooting technique and accuracy training that does not encumber a player.

OBJECTS OF THE INVENTION

It is therefore an object of the present invention to provide an improved training aid and method for developing muscle-memory in a user's shooting arm, wrist, and hand, for correctly shooting a basketball;

It is another object of the present invention to provide an improved training aid and method that teaches the hand, wrist, and arm in a correct manner of making a shot with a basketball without restrictive devices;

It is a further object of the present invention to provide an improved training aid and method that develops muscle-memory of the hand, wrist, and arm for proper execution of a basketball shot;

It is another object of the present invention to provide an improved training aid and method that teaches proper follow-through of the user's shooting hand after release of the basketball;

It is a still further object of the present invention to provide an improved training aid and method that is adaptable for different size users;

It is yet a another object of the present invention to provide an improved training aid and method that provides feedback to the user to indicate that the user has executed proper follow-through motion of their shooting hand;

It is a further object of the present invention to provide an improved training aid that is movable; and It is another object of the present invention to provide an improved training aid that comprises component parts that are detachable for facile storage and transportation of the aid.

SUMMARY OF THE INVENTION

These and other objects and advantages of the present invention are achieved by providing an improved training aid and method for developing muscle-memory in a user's shooting arm, wrist, and hand, when shooting a basketball. The invented training aid includes a shooting frame assembly, detachably coupled to two moveable base assemblies, so that the training aid can be moved about on a basketball court, for example. Repetitious shooting through a rectangular opening in the shooting frame, aids with establishing the connect muscle-memory in a user's shooting hand, wrist, and arm, for developing proper shooting technique. The length of the shooting frame can be increased, to increase the size of the rectangular opening in the shooting frame to accommodate more than one user.

A pair of extension assemblies are detachably coupled to the frame assembly and base assemblies. The extension assembly is slidably coupled to the base assembly for adjusting the height of the frame assembly. Each extension assembly can be adjusted independently of the other, so that the frame assembly may extend obtusely above the base assemblies, to accommodate plural users of different heights.

The training aid of the present invention is implemented by adjusting the frame assembly to a predetermined height, determined by adjusting the extension assemblies, until a shooting bar of the frame assembly extends parallel to a user's wrist, when the user's shooting arm is extended into a finished shooting position. The user is positioned under the opening in the frame assembly and provided with a basketball. The user projects the basketball through the opening in the frame, such that the arm changes from an initial position to the finished shooting position, for projecting the basketball towards a target. The motion is repeated to establish muscle-memory of the muscles in the user's shooting arm and the associated muscles, to train the muscles associated with shooting the basketball.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DESCRIPTION OF THE PREFERRED EMBODIMENTS

The following description is provided to enable any person skilled in the art to make and use the invention and sets forth the best modes contemplated by the inventor of carrying out the invention. Various modifications, however, will remain readily apparent to those skilled in the art, since the generic principles of the present invention have been defined herein.

Figure 1:
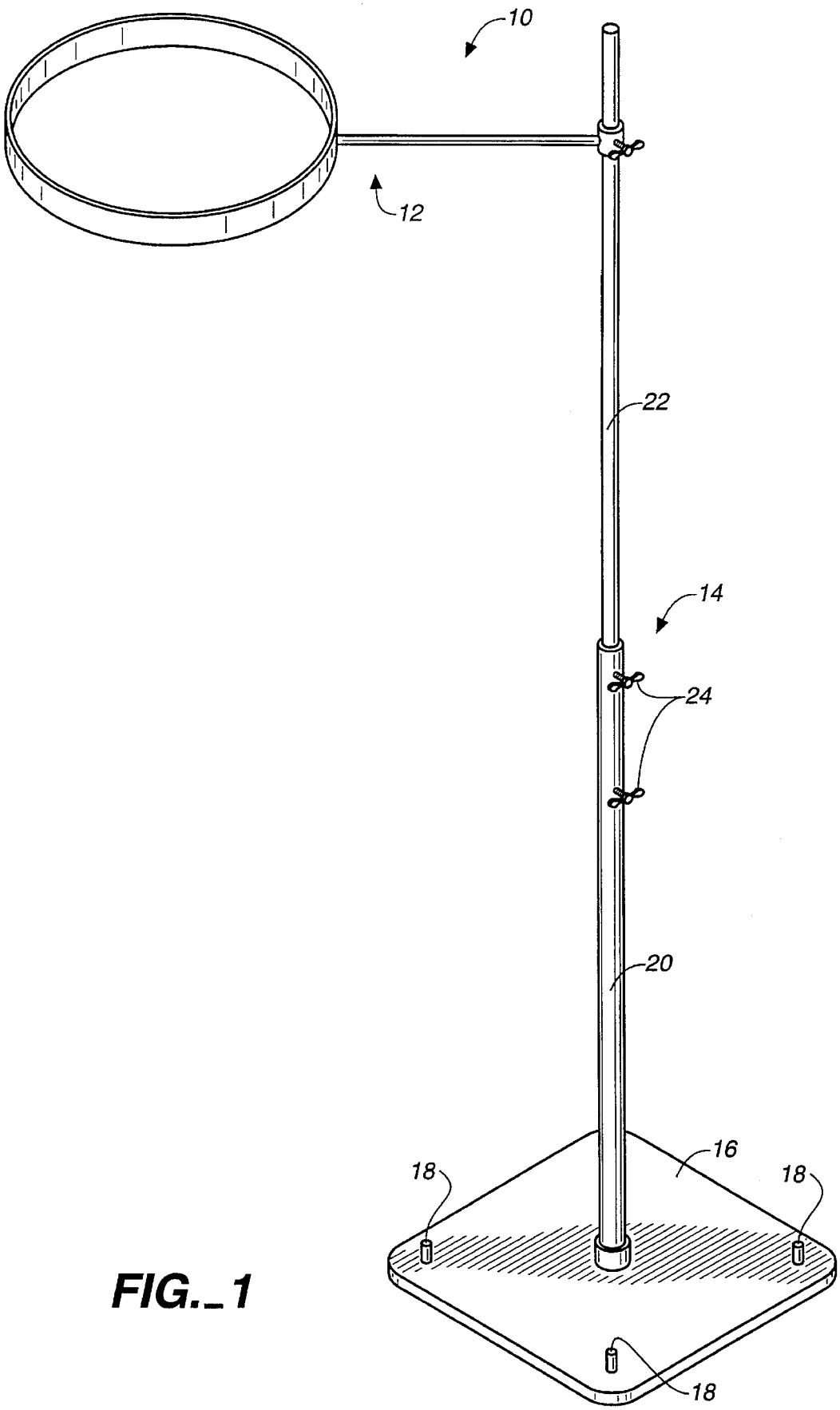
FIG. 1 is a perspective view of a prior embodiment of a muscle-memory basketball training aid.

Referring now to FIG. 1 of the drawings, a muscle-memory basketball training aid 10 as disclosed in co-pending application Ser. No. 08/320,437, is shown. The disclosed training aid 10 includes a field ring assembly 12 attached to a stand assembly 14. The stand assembly 14 includes a base 16, wheels 18, and an elongated support holder 20. A support member 22 is adjustably retained in the holder 20 for adjusting the height of the ring assembly 12. Locking means 24 are provided for locking the support member 22 in a desired position, relative to the support holder 20.

Figure 2:
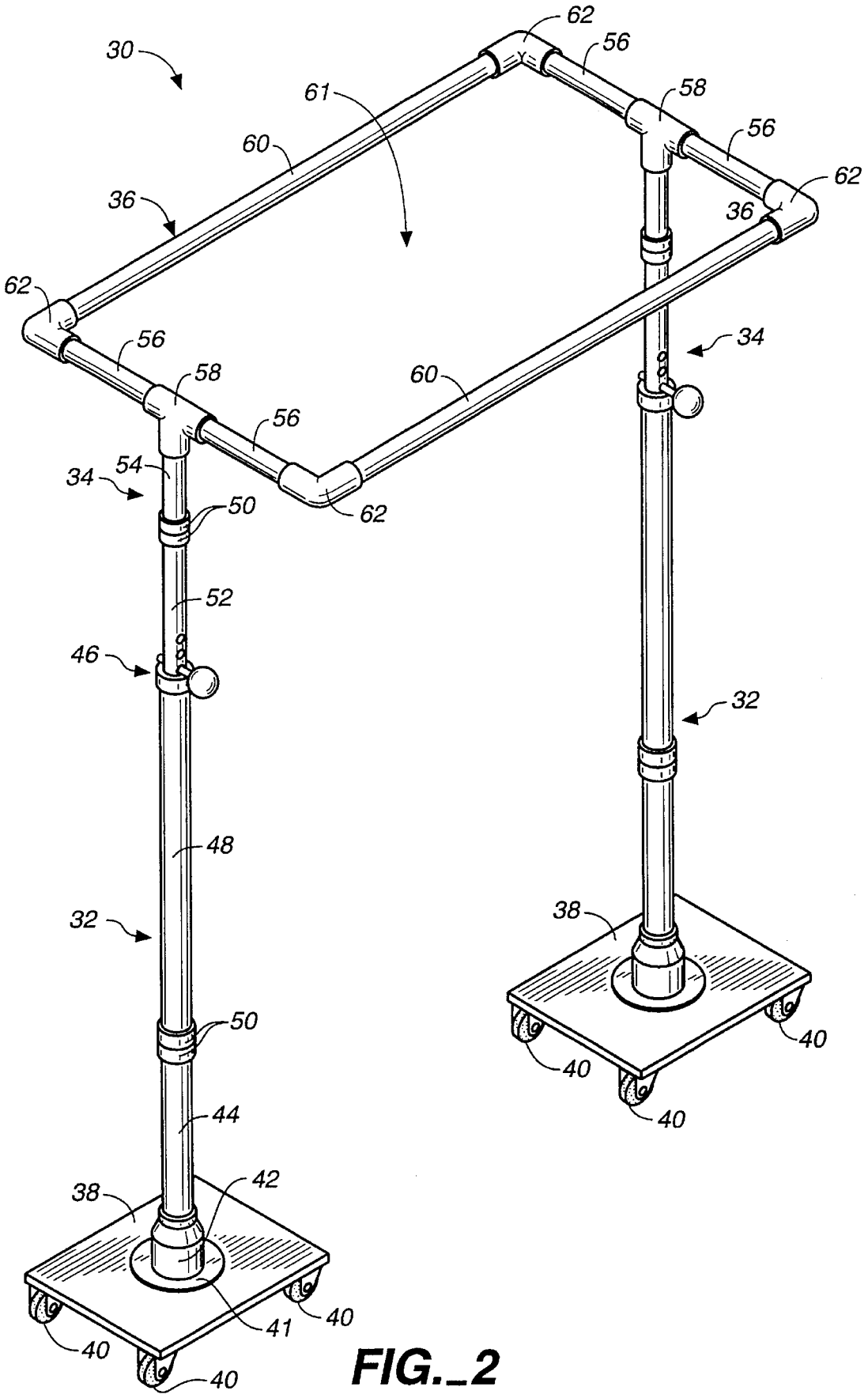
FIG. 2 is a perspective view of a preferred embodiment of a muscle-memory basketball training aid of the present invention.
Figure 3:
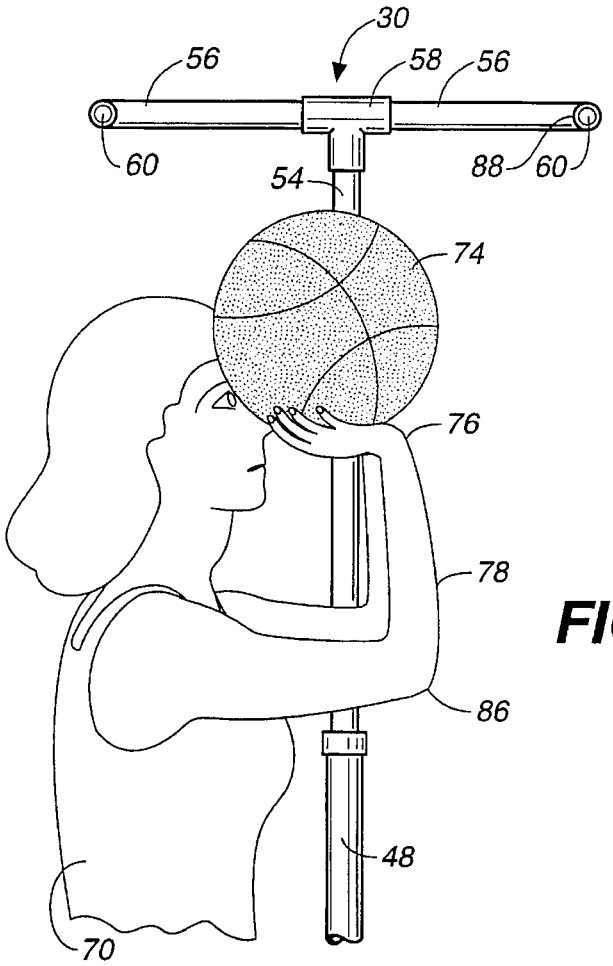
FIG. 3 is a side elevational, cross-section view of the preferred embodiment showing a user in an initial shooting position.

Referring now to FIG. 2 of the drawings, there is shown a preferred embodiment of a training aid 30 constructed according to the principles of the present invention. The invented training aid 30 comprises a base assembly 32, a frame extension assembly 34, and a shooting frame assembly 36. The base assembly 32 includes a base 38 that comprises a medium weight material such as ¾ inch plywood sheeting or similar weight material. The weight of the base 38 helps to prevent the aid 30 from accidentally tipping. The base 38 should be heavy enough to maintain balance of the base assembly 32 if the aid 30 is accidentally bumped with medium force. The base 38 may be provided with wheels 40 if desired. The invented aid 30 is moveable without the wheels 40, but if greater mobility is desired, preferably swiveling wheels 40 can be attached to the base 38.

The base assembly 32 consists of the base 38, wheels 40, and a base flange 41 attached to the base 38. An adapted 42 may be provided for coupling a base tubular member 44 to the base 38. The tubular member 44 may extend to a locking device 46. Alternatively, an extension 48 may be secured to the tubular member 44 using known methods. Preferably, couplings 50 are provided to enable the tubular member 44 and extension 48 to be screwed and unscrewed together.

The frame extension assembly 34 comprises the locking device 46 coupled to a frame tubular extension 52. The tubular extension 52 may be coupled to a tubular member 54 as previously discussed, enabling the frame extension assembly 34 to be disassembled.

The shooting frame assembly 36 is preferably substantially rectangular. The frame assembly 36 includes end bars 56 that are affixed to a connecting member 58, such as a T-fitting. A pair of shooting bars 60 are coupled to ends of the end bars 56 using L-shaped connecting members 62. Preferably, the L-shaped connecting members 62 comprise 90 degree elbow fittings that are affixed to the end bars 56 using known methods, such as gluing. The shooting bars 60 slip-fit to the elbows 62 for detachably forming the frame assembly 36. The T-fittings 58 are slip-fit onto the tubular members 54, for detachably coupling the frame assembly 36 to the extension assembly 34, for assembling the invented training aid 30.

Up to three additional shooting bars 60 may be added to accommodate additional users. The additional bars 60 are attached to the existing bars 60, for lengthening the frame 36.

Preferably, a suitable plastic tubing, such as well known ABS tubing, is used to fabricate the assemblies 32, 34, 36 of the aid 30. The preferred plastic tubing is an easily obtainable and workable material for all fitting and tubular members. The material is easily dimensioned with hand tools and components can be secured together with known adhesives, such as ABS cement. In the preferred embodiment, 2 inch diameter tubing was used for the base assembly 32, and 1 ½ inches diameter tubular material was used for the frame extension assembly 34 and shooting frame assembly 36. Tubing material that allows for a slight amount of flexibility in the training aid 30, but substantially heavy to hold the desired shape is preferred. If the training aid 30 is bumped by a user during use, slight flexibility in the aid 30, helps to maintain the aid's upright stability.

Referring now to FIGS. 3–6 of the drawings, a user 70 is shown standing under the muscle-memory training aid 30 at a correct position. The height of the muscle-memory training aid 30 is raised and lowered with the frame extension assembly 34 and held in place with the locking device 46.

In use, the user 70 is to avoid touching the shooting bars 60 of the frame assembly 36. If the user's hand 72 strikes the shooting bar 60, the semi-rigid material will flex on impact and therefore not injure the user 70. A basketball 74 must be released over the shooting bar 60, which forces the user 70 to project the ball 74 with the proper trajectory, using the correct arm, wrist, and hand technique. The invented aid 30 is adjusted to the correct height, when the shooting bars 60 of the frame 36 are parallel to the user's wrist 76, when the user's arm 78 is fully extended, into a finished shooting position. The correct position of the user 70 is directly under an opening 61 in the frame assembly 36.

Figure 7:
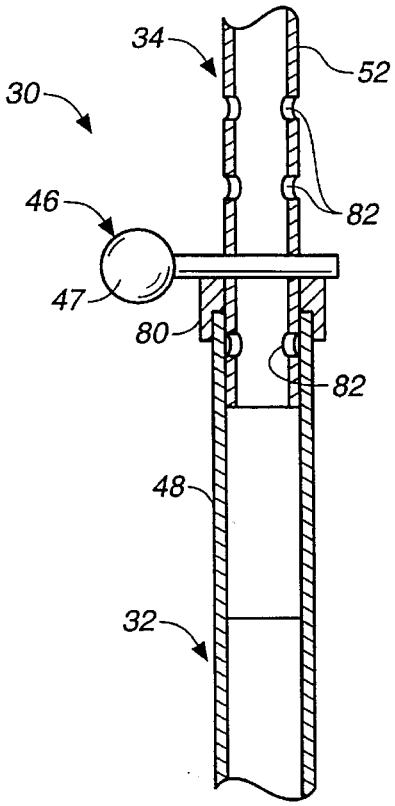
FIG. 7 cross-sectional view of a locking device for adjusting the height of the preferred embodiment of the muscle-memory basketball training aid of the present invention.

Referring now to FIG. 7 of the drawings, the locking device 46 is shown coupled to the frame extension assembly 34, for supporting the frame assembly 36 above the base assembly 32. The locking device 46 is used to adjust the height of the frame assembly 36 for usage by various size users 70. The frame tubular extension 52 extends through a slip-cap 80 and into the base tubular extension 48. A series of holes 82 are formed through the tubular extension 52. A bolt 47 or other such device, is inserted into a desired one of the holes 82 and through the tubular extension 52. This holds the shooting frame assembly 36 at a desired height.

The invented basketball training aid 30 is designed to be disassembled by unscrewing the various component sections. This provides an easily stored and transportable apparatus 30. Easy transport to various location and a relatively small amount of storage space are therefore additional assets of the invented aid 30.

Referring again to FIGS. 3–6, the shooting frame assembly 36 is adjusted to the proper height of each user 70. Proper height is established by raising frame extension assembly 34. According to the reach of each individual user 70, the frame assembly 36 is move up or down, with the frame extension assembly 34. When the training aid 30 is used by multiple users 70, each end of the frame assembly 36 can be raised or lowered independently of the other, so that the frame assembly 36 extends obtusely between the extension assemblies 34. Thus, the invented aid 30 can be used by different height users at the same time.

The user 70 stands directly under a shooting bar 60, with their arm 78 extended into the finished shooting position, wrist 76 and hand 72 are flexed, as in follow-through. The frame extension assembly 34 is raised or lowered to adjust the height of the frame assembly 36, so the edge of the shooting bar 60 is just touching the user's wrist 76.

The user 70 then stands under the shooting bar 60, facing a target 84, and projects the basketball 74 through the opening 61 and over the bar 60 above the user's head. In the initial shooting position, the user 70 has their elbow 86 directly below a front edge 88 of the shooting bar 60. The basketball 74 is lifted and projected up and over the shooting bar 60. In order to release the ball 74, the user 70 must extend the arm 78 up and flick the wrist 76 and fingers 90 over the shooting bar 60 and toward the target 84. This is the correct basketball shooting technique. Regular repetition of this movement, in a smooth and continuous manner, establishes the muscle-memory pattern required for a correctly executed shot.

Figure 4:
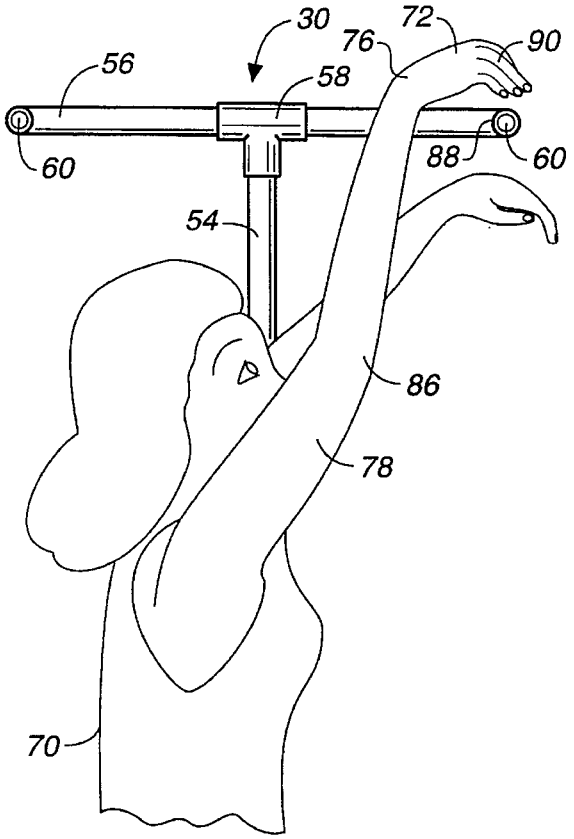
FIG. 4 is a side elevational, cross-section view of the preferred embodiment showing a user in a finished shooting position.
Figure 5:
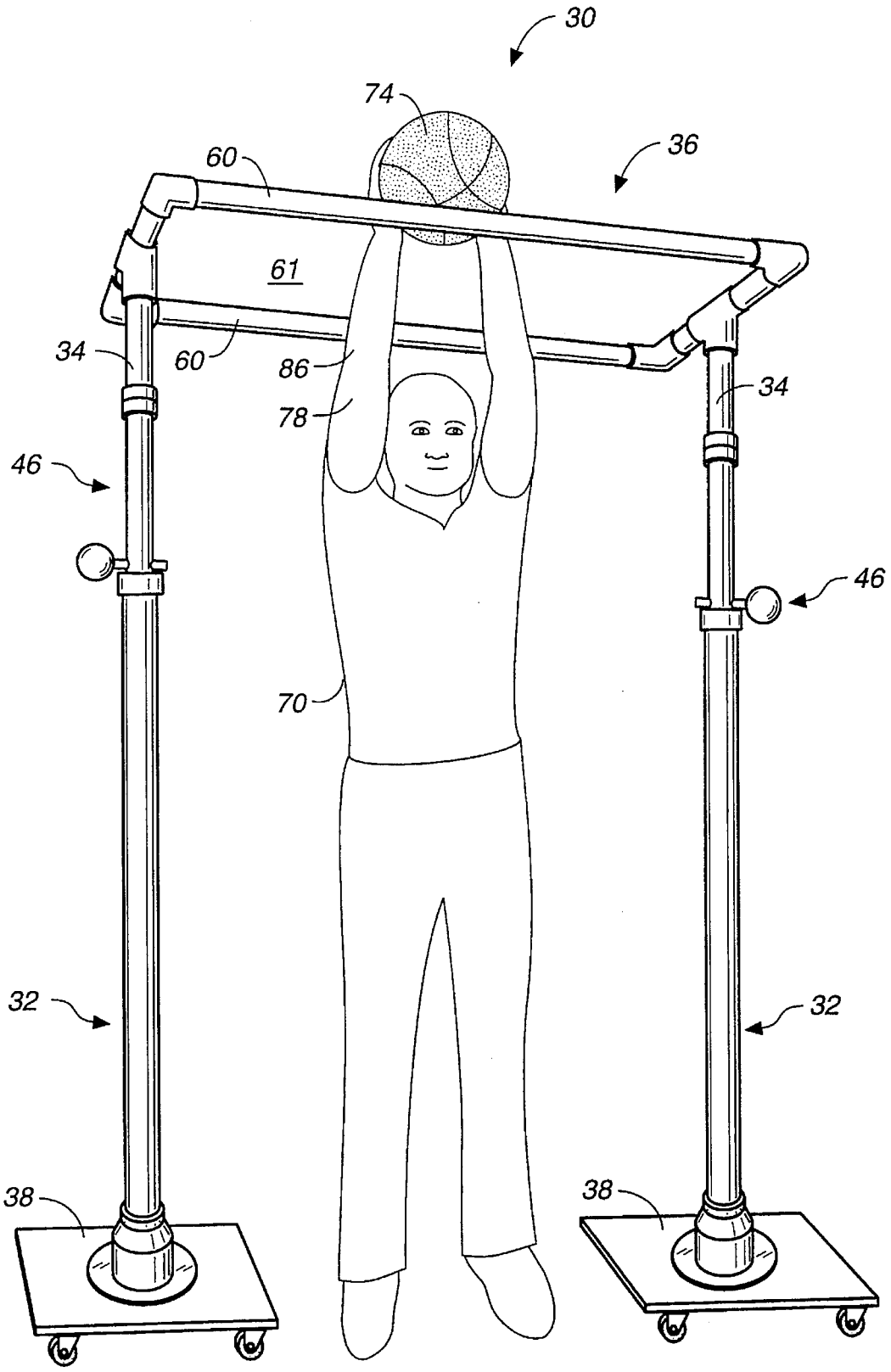
FIG. 5 is a front elevational view of the present invention showing the user in the initial shooting position.
Figure 6:
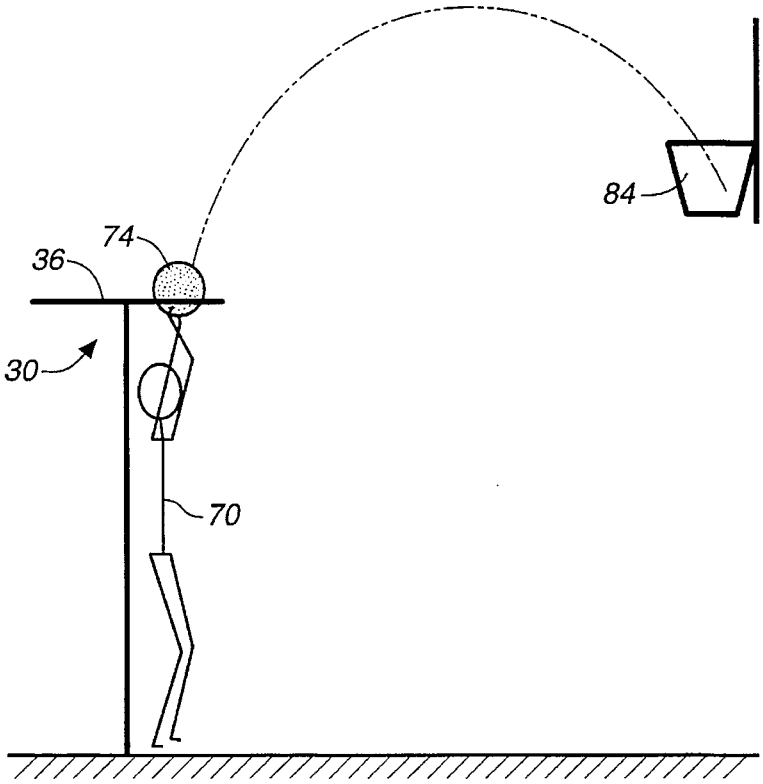
FIG. 6 is a side elevational, schematic view showing implementation of the preferred embodiment.

The ball 74 is projected to the target 84 by flicking the wrist 76 and fingers 90 of the upstretched arm 78 downward (best seen in FIG. 4). The arm 78 must be properly extended in order to shot the basketball 74 over the shooting bar 60. This flicking motion must coincide with the release of the basketball 74. Repetition establishes the muscle-memory pattern needed for retention of the correct movement.

Upon proper adjustment of the frame assembly 36, as described above, the user's hand 72 should just clear the shooting bar 60 as the basketball 74 is released. If upon release of the ball 74, the hand 72 does not clear the shooting bar 60, the user 70 immediately realizes that they have either improperly executed the follow-through of the hand 72 or the technique was not is executed in the desired smooth and continuous manner. The shooting frame assembly 36 may also be improperly positioned for the users arm 78 reach. The frame assembly 36 does not interfere with sighting or alignment of the shooting had 72 and arm 78, or lofting of the basketball 74.

Three users 70 can be accommodated facing the target 84, one to the left, one to the right, and a user 70 directly in the center of the frame assembly 36. Each end of the extension assembly 34 must be adjusted for the user 70 shooting adjacent to the extension assemblies 34. It is advisable that the users 70 not be of extreme difference in height.

For jump shot training, the frame assembly 36 is adjusted to the height of the user's wrist 76, when the basketball 74 is at the release point.

Incorporating the training aid of the present invention and method into the regular practice schedule will establish muscle-memory for proper shooting technique. Repetitive use on a regular basis is necessary to obtain the desired muscle-memory. Specifically, higher and more complete follow-through, greater extension of the arm, increase back-spin on the basketball, increased arc, and more accurate direction of the basketball flight are expected results. The invented training aid increases arm, wrist, and hand strength of the user, by repetitive use of the proper shooting muscles. Improved shooting accuracy, by establishing memory of the correct movements in the muscles of the arm, wrist, and hand, will also be a result of using the aid on a regular, consistent basis.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A muscle memory basketball training apparatus comprising:

a pair of base assemblies supporting said apparatus on a ground surface;

a rectangular frame assembly detachably coupled to said base assemblies, said frame assembly comprising a plurality of tubular members defining a rectangular opening therebetween, said plurality of tubular members detachably coupled together to provide a detachable frame; and support means detachably coupled to said frame assembly and to said base assembly, said support means adjustably supporting said frame assembly at a desired height above the ground surface, said support means including means for supporting said frame assembly obtusely above said ground surface.

2. The apparatus of claim 1 wherein said pair of base assemblies comprises a pair of planar, rectangular base members, each of said base members having a hollow support member detachably coupled thereto and extending upwardly therefrom.

3. The apparatus of claim 2 wherein said support means comprises first and second extension members coupled to said frame assembly and slidably retained in said support members for detachably coupling said base assemblies to said frame assembly.

4. The apparatus of claim 3 further comprising adjustment means coupled to said extension members for adjusting the height of said frame assembly relative to said ground surface, said adjustment means providing longitudinal adjustment of said extension members relative to said support members for adjusting the height of said frame assembly relative to said ground surface, said adjustment means including means for retaining said extension members at a desired longitudinal position relative to said support members for maintaining said frame assembly at the desired height, said adjustment means enabling each of said extension members to be adjusted independently of the other so that said frame assembly may extend obtusely above the ground surface to enable plural users of different heights to stand under said frame assembly.

5. The apparatus of claim 3 further comprising connecting means affixed to said frame assembly and detachably coupled to said extension members, said extension members slip-fitting to said connecting means for detachably coupling said support means to said frame assembly.

6. The apparatus of claim 2 further comprising a plurality of wheels affixed to each of said planar base members, a wheel affixed to an underside of said base member adjacent to each corner thereof.

7. The apparatus of claim 1 wherein said frame assembly comprises a pair of shooting bars detachably coupled to a pair of end bars for forming a rectangular opening therebetween, said frame assembly including means for slip-fitting said shooting bars to said end bars to detachably couple said shooting bars to said end bars, said opening dimensioned to enable a user to stand thereunder and project a basketball through said opening.

8. A muscle memory basketball training apparatus comprising:

first and second base assemblies for supporting said apparatus on a ground surface, each of said base assemblies including a hollow, tubular support member detachably coupled to a rectangular planar base member;

a rectangular frame assembly, said frame assembly comprising a pair of elongated shooting bars extending parallel to one another and a pair of end bars coupled to ends of the shooting bars, said end bars being substantially shorter than said shooting bars for forming a rectangular opening therebetween with the length of said opening being substantially greater than the width, said shooting bars slip-fitting to said end bars for forming a detachable frame; and first and second support means detachably coupled to said frame assembly and to said base assemblies for supporting said frame assembly, said support means comprising first and second extension members slip-fit to a center of said end bars and partially retained in said support members for detachably coupling said base assemblies to said frame assembly, said support means including adjustment means coupled to said extension members, said adjustment means enabling longitudinal adjustment of said extension members relative to said support members for adjusting the height of said frame assembly relative to said ground surface, said adjustment means including means for securing said extension members at a desired longitudinal position relative to said support member for maintaining said frame assembly at the desired height, said adjustment means enabling each of said extension members to be adjusted independently of the other, so that said frame assembly may extend obtusely above the ground surface to enable plural users of different heights to stand under the opening in said frame assembly and project a basketball therethrough.

9. The apparatus of claim 8 further comprising a plurality of wheels affixed to each of said planar base members, a wheel affixed to an underside of said base member adjacent to each corner thereof.

10. The apparatus of claim 8 wherein said adjustment means comprises a plurality of holes disposed through each of said extension members, along the longitudinal axis thereof, and bolt means adapted to be disposed through and reside in said holes of adjusting the height of said frame assembly relative to said ground surface and for maintaining said frame assembly at the desired height.

11. A method of training the muscles of a user associated with shooting a basketball toward a desired target, said method comprising the steps of:

providing a training apparatus, said apparatus comprising a base assembly, a rectangular frame assembly coupled to said base assembly, said frame assembly comprising a plurality of tubular members defining a rectangular opening therebetween, a pair of said tubular members comprising shooting bars, and support means coupled to said frame assembly and to said base assembly, said support means adjustably supporting said frame assembly at a desired height and further supporting said frame assembly at a desired angle relative to said base assembly;

adjusting the frame assembly to a predetermined height, said height being determined by adjusting the support means until the frame assembly is at a height where said shooting bar extends parallel to the user's wrist, when the user's shooting arm is extended into a finished shooting position;

positioning the user under the frame assembly, such that the user stands under the opening in the frame assembly with the elbow in their shooting arm positioned beneath a front edge of the shooting bar of said frame assembly, when the arm is in an initial position;

providing a basketball for the user to shoot, such that the basketball resides in the hand of the user's shooting arm;

projecting the basketball, with the user's shooting arm, through the opening in the frame assembly, such that the arm changes from the initial position to the finished shooting position for projecting the basketball towards the target, the fingers of the hand of the user's shooting arm extending over the shooting bar when the arm is in the finished shooting position; and repeatedly positioning the user under the frame assembly, providing the user with a basketball to shoot, and projecting the basketball, with the user's shooting arm, through the opening in the frame assembly, such that the arm changes from the initial position to the finished shooting position for projecting the basketball towards the target, to establish muscle-memory of the muscles in the user's shooting arm and the associated muscles to train the muscles associated with shooting the basketball.

12. The method of claim 11 comprising the further steps of:

providing a plurality of users;

dimensioning the opening in said frame assembly to accommodate said plurality of users;

simultaneously positioning each of said users under the opening in said frame assembly;

providing each of said users with a basketball to shoot;

each of said users simultaneously projecting their respective basketballs, with the user's shooting arm, through the opening in the frame assembly, such that the arm changes from the initial position to the finished shooting position for projecting the basketball towards the target, the fingers of the hand of each of the user's shooting arm extending over the shooting bar when the arm is in the finished shooting position; and repeatedly simultaneously positioning each of the users under the opening in said frame assembly, providing the users with basketballs to shoot, and projecting the basketballs through the opening in the frame assembly.

* * * * *